US007114327B2

(12) United States Patent
Greim

(10) Patent No.: US 7,114,327 B2
(45) Date of Patent: Oct. 3, 2006

(54) METHOD FOR OPERATING AN ELECTRO MOTOR-DRIVEN SECONDARY AIR PUMP

(75) Inventor: Andreas Greim, Weilheim A.D. Teck (DE)

(73) Assignee: Robert Bosch GmbH, Stuttgart (DE)

( * ) Notice: Subject to any disclaimer, the term of this patent is extended or adjusted under 35 U.S.C. 154(b) by 45 days.

(21) Appl. No.: 11/054,172

(22) Filed: Feb. 8, 2005

(65) Prior Publication Data

US 2005/0178108 A1 Aug. 18, 2005

(30) Foreign Application Priority Data

Feb. 12, 2004 (DE) ..... 10 2004 006 876

(51) Int. Cl.
*F01N 3/00* (2006.01)

(52) U.S. Cl. ..... 60/277; 60/287; 60/289

(58) Field of Classification Search ..... 60/277, 60/287, 289
See application file for complete search history.

(56) References Cited

U.S. PATENT DOCUMENTS 5,140,810 A * 8/1992 Kuroda ..... 60/274
5,615,552 A * 4/1997 Shimasaki et al. ..... 60/277
5,735,121 A * 4/1998 Kato et al. ..... 60/277
6,023,401 A * 2/2000 Hashimoto et al. ..... 361/93.1
6,393,833 B1 * 5/2002 Mizoguchi ..... 60/289
6,640,539 B1 * 11/2003 Lewis et al. ..... 60/284
6,920,413 B1 * 7/2005 Sumida et al. ..... 702/189

FOREIGN PATENT DOCUMENTS

DE 199 52 836 4/2001
DE 199 63 902 7/2001

* cited by examiner

*Primary Examiner*—Thomas Denion
*Assistant Examiner*—Loren Edwards
(74) *Attorney, Agent, or Firm*—Kenyon & Kenyon LLP

(57) ABSTRACT

A method for operating an electro motor-driven secondary air pump which is provided for injecting secondary air into the exhaust system of an internal combustion engine. The secondary air pump is operated in a clocked manner. The induced voltage at the electro motor of the secondary air pump, measurable during the turn-off time of the clocked operation, is used for diagnosing as well as for controlling the speed of the secondary air pump. The diagnosis is carried out based on the evaluation of a parameter (difference quotient, differential quotient) of the induced voltage. The induced voltage is instantaneously a measure for the secondary air pump's actual speed value, so that a separate detection of the actual speed value is omitted.

11 Claims, 2 Drawing Sheets

METHOD FOR OPERATING AN ELECTRO MOTOR-DRIVEN SECONDARY AIR PUMP

FIELD OF THE INVENTION

The present invention relates to a method for operating an electro motor-driven secondary air pump which is provided for injecting secondary air into the exhaust gas of an internal combustion engine.

BACKGROUND INFORMATION

A method is known from German Patent Application No. DE 116 09 922 in which the secondary air pump is checked on the basis of a response to a signal change of a lambda sensor situated in the exhaust gas of the internal combustion engine. Provided are an increase in the exhaust gas mass flow rate and a simultaneous switch-on of the secondary air pump. Due to the increased oxygen portion in the exhaust gas, the switch-on of the secondary air pump results in a signal change of the lambda sensor which in turn causes a response of a lambda controller of the engine control which carries out enrichment of the air-fuel mixture supplied to the engine. The increase in the exhaust gas mass flow rate may be achieved, for example, due to deteriorating efficiency of the engine, for example, by retarding the ignition of an externally ignited engine, by increasing the idle speed, or by connecting additional loads. If a response of the lambda controller is able to be determined, the secondary air pump is considered to be working correctly.

A further method for operating a secondary air pump is known from German Patent No. DE 199 52 836 in which an evaluation of the secondary air pump's operational performance is provided. The evaluation takes place based on the air-fuel mixture supplied to the engine, on the measured oxygen content of the exhaust gas, and on the measured air mass flow flowing to the engine.

German Patent Application No. DE 199 63 902 describes a method for operating an internal combustion engine, in which the focus is on a diagnosis of a catalytic converter. An increase in the hydrocarbon portion in the exhaust gas and simultaneously an increase in the secondary air result in an exothermic reaction in the catalytic converter. Based on the temperature control in the catalytic converter, it may be concluded that an increase in the secondary air has actually taken place and that the secondary air pump is working correctly.

A method and a device for monitoring the operational performance of a secondary air system of an internal combustion engine is known from German Patent Application No. DE 102 05 906 in which the electric operating current of the secondary air pump is analyzed. The secondary air pump may be operated using a variable power which is predefined within the scope of an electrical clocked operation. The electric operating current must lie within a predefined tolerance range, the tolerance range being a function of the pulse duty factor of the clocked operation. Moreover, the atmospheric pressure or the exhaust gas back-pressure may be taken into account. The operating voltage of the secondary air pump's electro motor may additionally be taken into account when predefining the tolerance range.

An object of the present invention is to provide a method for operating an electro motor-driven secondary air pump which makes easy adjustment of the secondary air flow rate and diagnosis of the secondary air system possible.

SUMMARY OF THE INVENTION

The present invention makes easy adjustment of the secondary air flow rate and easily executed diagnosis of the operational performance of the secondary air system possible. The electro motor-driven secondary air pump is operated in a clocked manner. During the clocked operation, the secondary pump's electro motor is connected to and disconnected from an electric power source in rapid time-based succession. The cycle period and/or the turn-on time or the turn-off time may be predefined. During the turn-off time, an induced voltage, which is proportional to the secondary air pump's speed, occurs in the secondary air pump's electro motor after decay of an inductive voltage portion. Diagnosis of the secondary air system takes place by comparing a parameter of the induced voltage to at least one predefined threshold value.

One embodiment provides that the actual value of the induced voltage is used as the parameter. The threshold value is to be defined as an induced voltage which must be exceeded in any case. An alternative or additional embodiment provides that the temporal change of the induced voltage is used as the parameter for the diagnosis. The differential quotient and/or the difference quotient may be analyzed. The analysis of the temporal change corresponds to an analysis of a change in the secondary air pump's speed during the turn-off time of the clocked operation.

One refinement provides that the induced voltage is only detected after a gating time, which follows the turn-on time, has elapsed. The effect of the inductive voltage portion is largely suppressed due to this measure.

One refinement provides that the at least one threshold value is corrected as a function of the supply voltage of the secondary air pump's electro motor. The effect of the supply voltage on the secondary air pump's speed is taken into account due to this measure.

A particularly advantageous embodiment of the method according to the present invention provides that the secondary air pump's speed is adjusted to a predefined speed setpoint value. This embodiment makes an accurate adaptation of the secondary air mass flow rate to the exhaust gas mass flow rate of the engine possible, thereby achieving efficient heating of an exhaust gas treatment device situated in the exhaust system of the engine under simultaneously minimal exhaust emission.

One refinement provides that the secondary air mass flow rate setpoint value is defined as a function of a predefined lambda setpoint value of the engine. An intended exhaust gas composition without a change in the fuel mass supplied to the engine may be maintained via this measure. Variations within the series due to deviating mechanical tolerances may be compensated within the scope of an adaptation, in particular at the initial startup of the engine.

DETAILED DESCRIPTION

Figure 1:
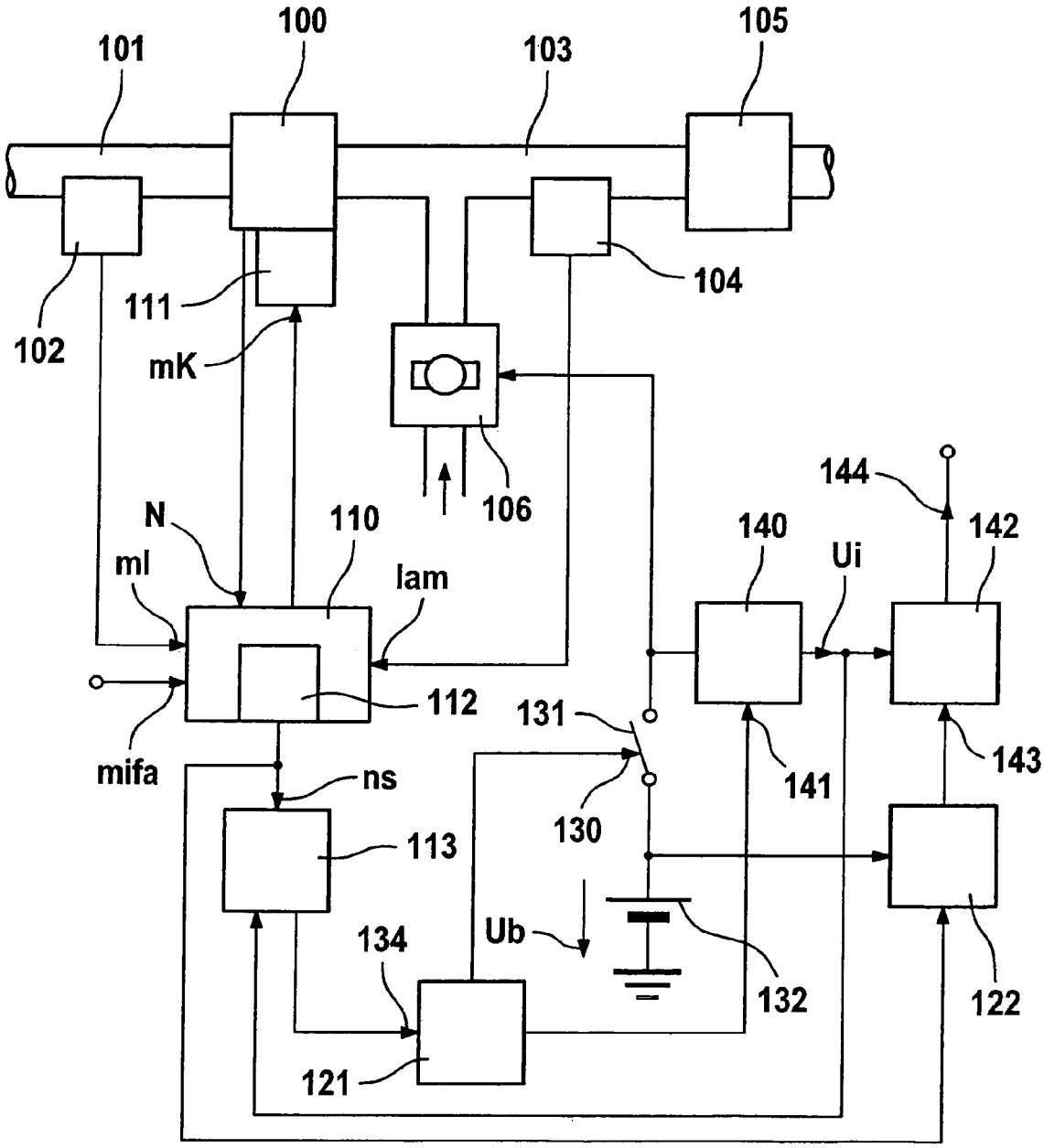
FIG. 1 shows a technical environment in which a method according to the present invention is executed.

FIG. 1 shows an internal combustion engine 100, an airflow rate sensor 102 being situated in its intake system 101 and a lambda sensor 104 as well as an exhaust gas treatment device 105 being situated in its exhaust system 103. Secondary air, which is delivered by an electro motor-driven secondary air pump 106, may be injected into exhaust system 103.

An engine control 110 is supplied with an air flow rate signal ml provided by air flow rate sensor 102, a speed signal N provided by engine 100, a lambda signal lam provided by lambda sensor 104 and a torque setpoint signal mifa.

Engine control 110 transmits a fuel signal mK to a fuel metering device 111 which is assigned to engine 100. Engine control 110 contains a speed setpoint value-determination 112 which forwards a measure for a speed setpoint value ns of secondary air pump 106 to a speed controller 113, which in turn transmits a control signal 134 to a pulse width modulator 121.

Using a switch control signal 130, pulse width modulator 121 controls a switch 131 which connects a power source 132 to the electro motor of secondary air pump 106. Power source 132, which is connected to a threshold value selector 122, has a supply voltage referred to as Ub.

A gate circuit 140 is connected to the electro motor of secondary air pump 106. Using a gate signal 141, gate circuit 140 is controlled by pulse width modulator 121. Gate circuit 140 provides an induced voltage Ui which is available to speed controller 113 as well as to a comparator 142. Comparator 142, supplied with a threshold value 143 by threshold value selector 122, provides a diagnostic signal 144.

Figure 2:
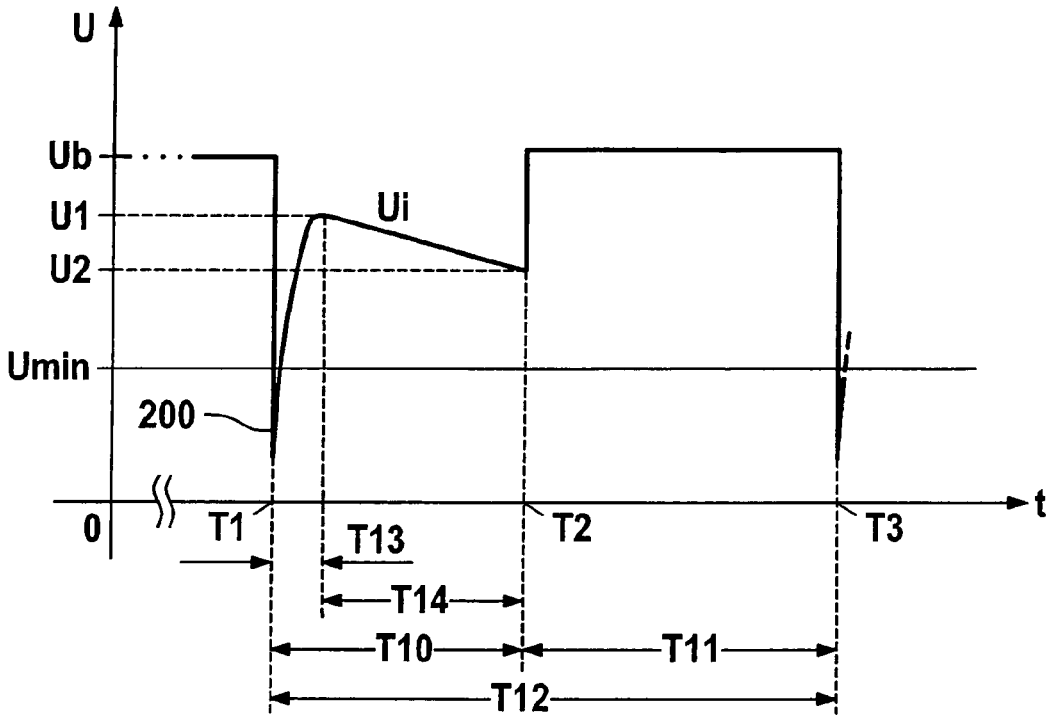
FIG. 2 shows a voltage characteristic as a function of time.

FIG. 2 shows a voltage characteristic U as a function of time t. At point in time zero, voltage characteristic U has supply voltage Ub of power source 132. A turn-off time T10 starts at a first point in time T1; the turn-off time ends at a second point in time T2 at which a turn-on time T11 starts. Turn-on time T11 ends at a third point in time T3. Turn-off time T10 and turn-on time T11 together form a cycle period T 12. Starting with first point in time T1, a gating time T13 lies within turn-off time T10. The remaining time during turn-off time T10 is a measuring time T14.

An inductive voltage peak 200 occurs during gating time T13. After gating time T13 has elapsed, induced voltage Ui occurs which has a maximum voltage U1 and a minimum voltage U2, minimum voltage U2 coinciding with second point in time T2. After second point in time T2, voltage U jumps again to supply voltage Ub of power source 132. A voltage Umin is indicated as an example of a threshold value 143.

Figure 3:
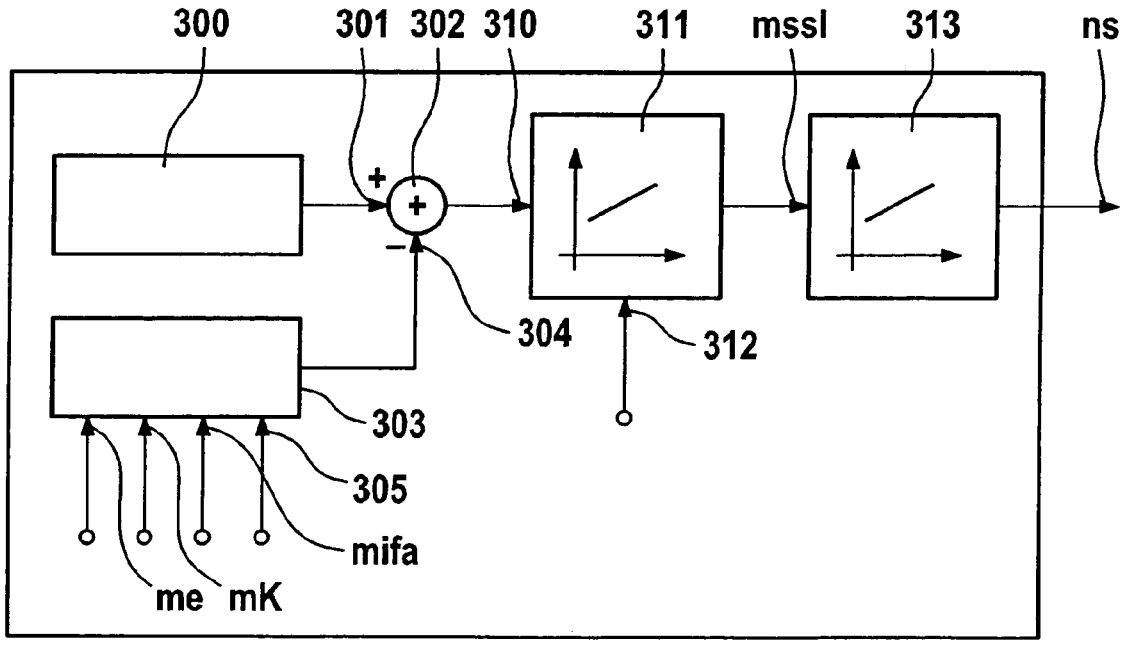
FIG. 3 shows in detail how a speed setpoint value is determined.

FIG. 3 shows in detail the speed setpoint determination 112 contained in engine control 110. Provided is a setpoint heat quantity selector 300 which gives out a setpoint heat quantity 301 to an adder 302. Moreover, an engine heat quantity determination 303 is provided which gives out an engine heat quantity 304 to adder 302. Air flow rate signal ml, fuel signal mK, torque setpoint signal mifa, and an additional input signal 305 are supplied to engine heat quantity determination 303.

Adder 302 forwards an effective heat quantity 310 to a secondary air mass flow rate determination 311 which is also supplied with a setpoint lambda 312. A secondary air mass flow rate setpoint value mssl, determined by secondary air mass flow rate determination 311, is supplied to a speed setpoint value predefinition 313 which provides the measure for speed setpoint value ns.

The method works as follows:

Injection of secondary air into exhaust system 103 of engine 100 is provided for elevating the temperature of exhaust treatment device 105. Exhaust treatment device 105 may be, for example, at least one catalytic converter and/or a particle filter and/or another device provided for emission control. Exhaust treatment device 105 may have a minimum operating temperature and, for correct operation, exhaust treatment device 105 may not fall below that minimum temperature. In a different case, an elevated temperature of exhaust treatment device 105 may be necessary to regenerate exhaust treatment device 105. Heating of exhaust treatment device 105 may become necessary in particular at a cold start of engine 100 or at a restart after an extended shut-off phase of engine 100.

The secondary air injected into the exhaust system, in particular into an exhaust manifold, reacts with combustible exhaust gas components which are suitably inserted into the exhaust gas. The additional insertion of combustible exhaust gas components results in increased fuel consumption of engine 100. Hence, targeted injection of the secondary air is necessary to ensure operation of engine 100 which is as fuel efficient as possible. Moreover, undesirable exhaust gas components, which exhaust treatment device 105 may no longer be able to remove, may occur when the secondary air quantity is too high or too low. Also because of this reason, it is desirable to meter the secondary air as exactly as possible.

Engine control 110 determines fuel signal mK for fuel metering device 111 at least as a function of speed N of engine 100 and/or of air flow rate signal ml and/or of lambda signal lam and/or of torque setpoint signal mifa, torque setpoint signal mifa corresponding to a position of an accelerator pedal (not shown) for example.

Speed setpoint value determination 112, preferably contained in engine control 110, determines the measure for speed setpoint value ns of the electro motor (not shown) of secondary air pump 106. In the following, reference is made only to secondary air pump 106. The starting point is setpoint heat quantity selector 300 which, during a calibration of engine control 110 for example, may be set to a value necessary for adequately heating exhaust treatment device 105 in order to meet predefined exhaust gas limiting values at predefined points in time. Part of the necessary heat quantity is provided by engine 100 itself. The contribution is determined by engine heat quantity determination 303. The determination may take place, for example, as a function of air flow rate signal ml and/or of fuel signal mK and/or of torque setpoint signal mifa and/or speed N (not shown) of engine 100, as well as of further input signal 305. Further input signal 305 reflects, for example, the efficiency of the engine at a given working point. Provided that lambda sensor 104 is operational, lambda signal lam may additionally be taken into account.

Adder 302 subtracts engine heat quantity 304, determined by engine heat quantity determination 303, from setpoint heat quantity 301 of setpoint heat quantity selector 300 and forwards effective heat quantity 310 to secondary air mass flow rate determination 311.

As a function of effective heat quantity 310 and possibly as a function of a predefined setpoint lambda 312, secondary air mass flow rate determination 311 defines secondary air mass flow rate setpoint value mssl. Setpoint lambda 312 may be adapted during the initial startup of engine 100, as well as during subsequent operation after lambda sensor 104 became operational. As a function of secondary air mass flow rate setpoint value mssl, speed setpoint value predefinition 313 defines the measure for speed setpoint value ns which is supplied to speed controller 113.

Pulse width modulator 121 defines switch control signal 130 for switch 131 based on control signal 134 provided by speed controller 113. Switch control signal 130 contains cycle period T12, turn-off time T10, and turn-on time T11 lying within that cycle period. Cycle period T12 is to be adjusted to the electro motor of secondary air pump 106. In connection with switch 131, switch control signal 130 selects a clocked operation of secondary air pump 106 in which, by operating at a predefined efficiency level, secondary air pump 106 is supposed to work at the predefined setpoint speed. The periodic connection of secondary air pump 106 to power source 132 results in a selection of a middle operating voltage level of secondary air pump 106. Cycle period T12 of switch control signal 130 is between 10 milliseconds and 100 microseconds, for example. A longer cycle period T12 increasingly reduces the advantages of the clocked operation. A shorter cycle period T12 results in increased strain on switch 131. The middle operating voltage level is set via a variation of turn-off time T10 and turn-on time T11.

The clocked operation makes it possible to determine the speed of secondary air pump 106 using induced voltage Ui which occurs within turn-off time T10. The part of induced voltage Ui, which reflects the speed, occurs after decay of inductive voltage peak 200. Gate circuit 140 has the task to gate the inductive voltage peak, occurring during gating time T13, as well as supply voltage Ub, present during turn-on time T11. Induced voltage Ui, which is supplied to both comparator 142 and speed controller 113, occurs at the output of gate circuit 140. Induced voltage Ui is simultaneously a measure for the actual speed value of secondary air pump 106.

According to a first exemplary embodiment, induced voltage Ui is instantaneously compared in comparator 142 to at least one threshold value 143 provided by threshold value selector 122. Threshold value 143 corresponds, for example, to voltage Umin listed in FIG. 2. If induced voltage Ui falls below voltage Umin, it may be assumed that the speed of secondary air pump 106 is too low. Sluggishness of secondary air pump 106 could be present. If induced voltage Ui drops to a zero value, then it must be assumed that secondary air pump 106 is blocked or a connection is interrupted.

The difference of induced voltage Ui which occurs during measuring time T14 may additionally or alternatively be evaluated. The difference between maximum voltage U1 and minimum voltage U2 may be determined in the shown exemplary embodiment. Moreover, determination of a difference quotient may additionally or alternatively be provided. A reference to measuring time T14 is not necessary here, provided that measuring time T14 is constant during comparable measurements.

Moreover, the momentary increase in induced voltage Ui may additionally or alternatively be determined, which corresponds to determining a differential quotient. In all of these cases, it is a matter of determining the change in induced voltage Ui. An evaluation of the determined change takes place by correspondingly selecting threshold values for the difference quotient and/or the differential quotient. The determination of the difference quotient and/or the differential quotient provides a measure for the deceleration of secondary air pump 106 during measuring time T14.

A faulty opening cross section of a secondary air valve, not shown in FIG. 1, could be present in addition to sluggishness of secondary air pump 106.

Provided that an excess or a shortfall of the at least one predefined threshold value 143 is detected in comparator 142, comparator 142 provides diagnosis signal 144 which reflects an error in the secondary air system of engine 100.

Obtaining induced voltage Ui during measuring time T14 has the considerable advantage that induced voltage Ui may instantaneously be used as a measure for the actual speed value of secondary air pump 106. Therefore, induced voltage Ui makes it possible without additional expense to implement the speed regulation of secondary air pump 106 using speed controller 113.

What is claimed is:

1. A method for operating an electro motor-driven secondary air pump which is provided for injecting secondary air into an exhaust system of an internal combustion engine, the method comprising:

operating the secondary air pump in a clocked manner, at least one of (a) a cycle period and (b) one of a turn-off time and a turn-on time of an operating voltage of the secondary air pump being set during the clocked operation;

providing a diagnosis of the secondary air pump by evaluating a parameter of an induced voltage occurring at the secondary air pump during the turn-off time;

comparing the parameter to at least one predefined threshold value; and signaling an exceeding of the threshold value by a diagnostic signal.

2. The method according to claim 1, wherein an amount of the induced voltage is used as the parameter.

3. The method according to claim 1, wherein a temporal change in the induced voltage is used as the parameter.

4. The method according to claim 1, wherein the evaluation of the parameter is provided during a predefined measuring time which starts after a gating time has elapsed.

5. The method according to claim 1, further comprising changing the at least one threshold value as a function of at least one of (a) a supply voltage of a power source of an electro motor of the secondary air pump and (b) a measure for a speed setpoint value of the secondary air pump.

6. The method according to claim 1, further comprising providing a regulation of a speed of the secondary air pump, and wherein the induced voltage, detected during the turn-off time, is used as a measure for an actual speed value.

7. The method according to claim 1, further comprising setting a secondary air mass flow rate setpoint value of the secondary air pump as a function of a predefined setpoint lambda of an exhaust gas of the internal combustion engine.

8. The method according to claim 1, further comprising providing an adaptation of a predefined setpoint lambda as a function of a measured lambda signal according to an operational readiness of a lambda sensor situated in the exhaust system of the internal combustion engine.

9. The method according to claim 1, further comprising setting a secondary air mass flow rate setpoint value as a function of a difference between a predefined setpoint heat quantity and an internal combustion engine heat quantity which reflects a heat quantity provided by the internal combustion engine.

10. The method according to claim 1, wherein the parameter is a difference quotient.

11. The method according to claim 1, wherein the parameter is a differential quotient.

* * * * *